US011091334B2

(12) United States Patent
Aono et al.

(10) Patent No.: US 11,091,334 B2
(45) Date of Patent: Aug. 17, 2021

(54) SHEET CONVEYANCE APPARATUS AND IMAGE FORMING APPARATUS

(71) Applicant: CANON KABUSHIKI KAISHA, Tokyo (JP)

(72) Inventors: Kazuhiko Aono, Numazu (JP); Yasuaki Matsumoto, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/542,160

(22) Filed: Aug. 15, 2019

(65) Prior Publication Data

US 2019/0367301 A1 Dec. 5, 2019

Related U.S. Application Data

(63) Continuation of application No. 15/796,024, filed on Oct. 27, 2017, now Pat. No. 10,435,258.

(30) Foreign Application Priority Data

Oct. 31, 2016 (JP) ..... 2016-213532

(51) Int. Cl.
*B65H 3/06* (2006.01)
*B65H 3/52* (2006.01)
*B65H 27/00* (2006.01)

(52) U.S. Cl.
CPC ..... *B65H 3/0638* (2013.01); *B65H 3/5261* (2013.01); *B65H 27/00* (2013.01);
(Continued)

(58) Field of Classification Search
CPC ..... B65H 3/0638; B65H 2404/1523; B65H 2404/152; B65H 2405/42; B65H 2405/34; B65H 2402/45; B65H 2601/324
See application file for complete search history.

(56) References Cited

U.S. PATENT DOCUMENTS 6,059,280 A * 5/2000 Yamauchi ..... B65H 3/5261 193/35 R
6,102,388 A * 8/2000 Thornhill ..... B65H 3/063 271/10.11

(Continued)

FOREIGN PATENT DOCUMENTS

JP 2001-270626 A 10/2001
JP 2003-118862 A 4/2003
JP 2009-269686 A 11/2009

*Primary Examiner* — Patrick Cicchino
(74) *Attorney, Agent, or Firm* — Canon U.S.A., Inc. I.P. Division

(57) ABSTRACT

A sheet conveyance apparatus includes a storage unit storing a sheet, a conveyance member to convey a sheet, a support shaft portion, and a separation unit. The support shaft portion has one end fixed to a main body of the sheet conveyance apparatus and the other end as a free end that is not fixed to the main body. The separation unit pinches and conveys a sheet with the conveyance member and separates a plurality of sheets stored in and fed from the storage unit one by one. The separation unit includes a separation member that is supported by the support shaft portion and rotatable with the support shaft portion, and a holding member to hold the separation member. By moving the holding member in an axial direction of the support shaft portion, the separation unit is removed from the apparatus with the holding member holding the separation member.

14 Claims, 11 Drawing Sheets

(52) U.S. Cl.
CPC ..... *B65H 2402/31* (2013.01); *B65H 2402/32* (2013.01); *B65H 2404/1523* (2013.01); *B65H 2405/42* (2013.01); *B65H 2601/324* (2013.01)

(56) References Cited

U.S. PATENT DOCUMENTS

| | | | | |
|---|---|---|---|---|
| 8,585,039 | B2 * | 11/2013 | Murata | B65H 1/266 271/18 |
| 8,894,061 | B2 * | 11/2014 | Matsuoka | B65H 1/266 271/10.13 |
| 9,389,577 | B2 * | 7/2016 | Taniguchi | B65H 5/062 |
| 10,435,258 | B2 * | 10/2019 | Aono | B65H 3/0638 |
| 10,584,006 | B2 * | 3/2020 | Suzuki | B65H 3/0684 |
| 10,656,587 | B2 * | 5/2020 | Koga | G03G 15/6511 |
| 2009/0267293 | A1 * | 10/2009 | Watanabe | B65H 3/0638 271/264 |
| 2014/0084534 | A1 * | 3/2014 | Ichikawa | B65H 3/0684 271/109 |
| 2017/0031295 | A1 * | 2/2017 | Matsumoto | B65H 3/0684 |
| 2017/0060066 | A1 * | 3/2017 | Fujita | B65H 3/0638 |
| 2020/0012224 | A1 * | 1/2020 | Itabashi | B65H 3/0607 |

* cited by examiner

SHEET CONVEYANCE APPARATUS AND IMAGE FORMING APPARATUS

CROSS REFERENCE TO RELATED APPLICATIONS

This application is a continuation of U.S. patent application Ser. No. 15/796,024, filed on Oct. 27, 2017, which claims priority from Japanese Patent Application No. 2016-213532, filed Oct. 31, 2016, all of which are hereby incorporated by reference herein in their entirety.

BACKGROUND

Field of the Invention

The present disclosure relates to a sheet conveyance apparatus that conveys sheets and to an image forming apparatus including the sheet conveyance apparatus.

Description of the Related Art

There is a conventional image forming apparatus such as a printer, a copying machine, or a facsimile in which a sheet stored in a sheet supplying cassette is conveyed by a feed roller included in a sheet conveyance apparatus and then the sheet is conveyed to an image forming unit. The sheet conveyance apparatus includes a separation unit that separates sheets one by one when two or more sheets are conveyed by the feed roller.

As an example of the separation unit, there is a retard separation type of separation unit that includes a conveyance roller rotating in a forward rotation direction, which is the same direction as the direction in which the corresponding feed roller rotates, and a retard roller functioning as a separation member that comes into contact with the conveyance roller with a predetermined pressure. The retard roller is provided with driving force via a torque limiter and can rotate in the forward and reverse rotation directions.

In the retard separation type of separation unit, when two or more sheets are inserted into a separation nip portion formed by the retard roller and the conveyance roller of the separation unit, the retard roller rotates in the forward rotation direction. As a result, the sheet being in contact with the conveyance roller is conveyed toward the corresponding image forming unit, and the sheet being in contact with the retard roller is conveyed toward the corresponding sheet supplying cassette. Consequently, the two or more sheets can be prevented from being conveyed with overlaps. The retard separation type of separation unit utilizes the friction between a surface of the sheet and a surface of the retard roller. However, since this friction gradually wears down the surface of the retard roller and deteriorates the separation performance, the retard roller needs to be replaced regularly.

Japanese Patent Application Laid-Open No. 2015-75497 discusses improving the replacement performance of the retard roller. According to this technique, a retard roller is attached to a free end of a drive shaft supported at only one end. With this configuration, a user can replace the retard roller by removing the retard roller from the free end of the drive shaft.

However, with the configuration discussed in Japanese Patent Application Laid-Open No. 2015-75497, when a user replaces the retard roller, it is difficult for the user to hold the retard roller, which may deteriorate the replacement performance of the retard roller. For example, when replacing a retard roller configured to have a smaller diameter or when an access path to a retard roller in a sheet conveyance apparatus is narrow, it is difficult for the user to hold the retard roller.

SUMMARY

The present disclosure is directed to a sheet conveyance apparatus having a separation member with replacement performance.

According to an aspect of the present invention, a sheet conveyance apparatus includes a storage unit configured to store a sheet, a conveyance member configured to convey a sheet, a support shaft portion having one end as a fixed end that is fixed to a main body of the sheet conveyance apparatus and the other end as a free end that is not fixed to the main body, and a separation unit configured to pinch and convey a sheet with the conveyance member and to separate a plurality of sheets stored in and fed from the storage unit one by one, wherein the separation unit includes a separation member that is supported by the support shaft portion and rotatable with the support shaft portion, and a holding member capable of holding the separation member, wherein, by moving the holding member in an axial direction of the support shaft portion, the separation unit is removed from the sheet conveyance apparatus with the holding member holding the separation member.

Further features of the present invention will become apparent from the following description of embodiments with reference to the attached drawings.

DESCRIPTION OF THE EMBODIMENTS

Hereinafter, embodiments of the present invention will be described in detail with reference to the accompanying drawings. Each of the following embodiments will be described based on an example in which a laser beam printer is used as an image forming apparatus including a sheet conveyance apparatus according to the corresponding embodiment. However, the components described in the following embodiments are only examples. Unless otherwise specified, the description of the components will not limit the scope of the present invention.

Figure 1:
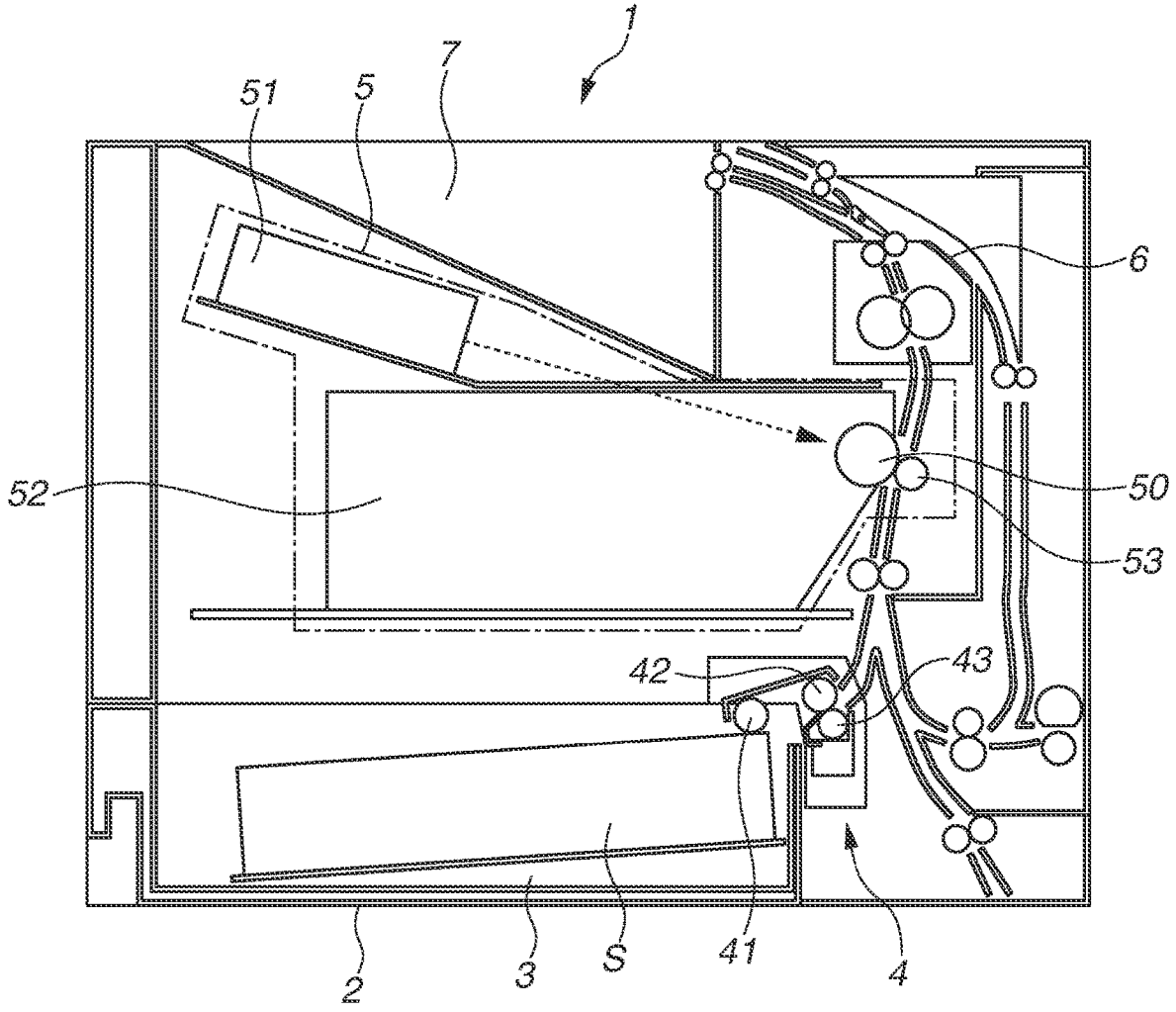
FIG. 1 is a schematic cross section illustrating a configuration of an image forming apparatus including a sheet conveyance apparatus according to a first embodiment.

FIG. 1 is a schematic cross section illustrating a configuration of an image forming apparatus 1 including a sheet conveyance apparatus according to a first embodiment. As illustrated in FIG. 1, the image forming apparatus 1 forms an image on a sheet by using an electrophotographic recording method and includes a housing 2, a sheet supplying cassette 3 that functions as a storage unit storing sheets, a feed unit 4 (the sheet conveyance apparatus), an image forming unit 5, a fixing unit 6, and a sheet discharge tray 7.

The feed unit 4 includes a feed roller 41 that feeds a sheet S stored in the sheet supplying cassette 3, a conveyance roller 42 which functions as a conveyance member that conveys the sheet S fed by the conveyance feed roller 41, and a separation unit 43. When a plurality of sheets S is conveyed by the feed roller 41 from the sheets S stored in the sheet supplying cassette 3, the conveyance roller 42 and the separation unit 43 separate the conveyed sheets S and convey only one sheet toward the image forming unit 5. The configuration of the feed unit 4 that feeds the sheets S will be described in detail below.

The image forming unit 5 includes a photosensitive drum 50 that functions as an image bearing member, an exposure unit 51, a developing unit 52, and a transfer roller 53. When a control unit (not illustrated) such as a controller receives an image signal, an image forming operation is started, and the photosensitive drum 50 is rotated. When rotated, the photosensitive drum 50 is electrically charged evenly by a charging unit (not illustrated) and is exposed by the exposure unit 51 in accordance with the image signal. As a result, an electrostatic latent image is formed on the surface of the photosensitive drum 50. Next, this electrostatic latent image is developed by the developing unit 52, and as a result, a toner image is formed on the surface of the photosensitive drum 50. The transfer roller 53 comes into contact with the photosensitive drum 50 and forms a transfer nip portion with the photosensitive drum 50. After the toner image formed on the surface of the photosensitive drum 50 is transferred onto the sheet S fed by the feed unit 4 at the transfer nip portion, the fixing unit 6 applies heat and pressure to fix the toner image on the sheet S. In this way, an image is formed on a sheet S in the image forming unit 5. Then, the sheet S passes through the fixing unit 6, and the sheet S that has undergone printing processing is discharged onto the sheet discharge tray 7.

[Configuration of Feed Unit]

Hereinafter, a configuration of the feed unit 4 of the image forming apparatus 1 according to the present embodiment and an operation of separating and conveying the sheets S one by one by the separation unit 43 will be described in detail with reference to FIGS. 2 to 5B.

Figure 2:
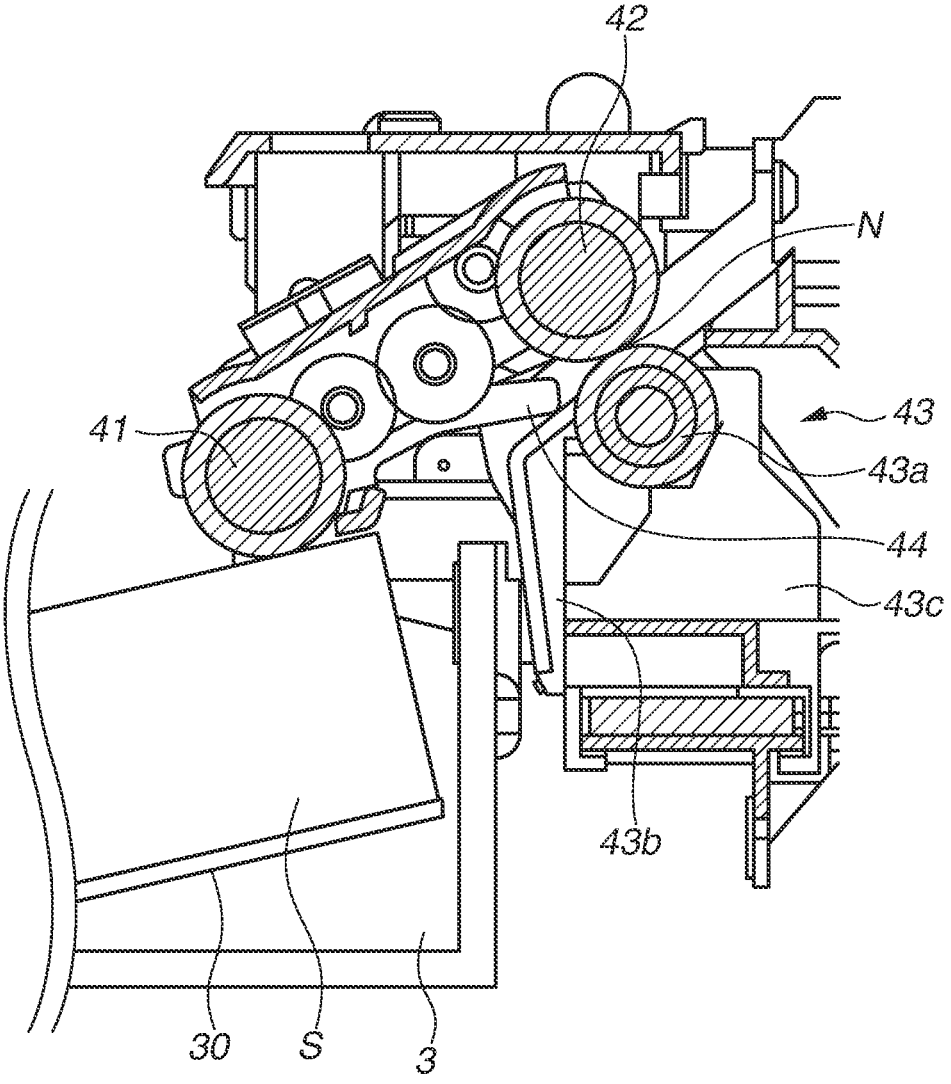
FIG. 2 is a schematic cross section of a feed unit taken along a sheet conveyance direction according to the first embodiment.

FIG. 2 is a schematic cross section of the feed unit 4 taken along a sheet conveyance direction according to the first embodiment. As illustrated in FIG. 2, the separation unit 43 includes a retard roller 43*a* as a separation member, a separation nip guide 43*b*, a holder 43*c* as a holding member holding the retard roller 43*a* and the separation nip guide 43*b*. By coming into contact with the conveyance roller 42, the retard roller 43*a* forms a separation nip portion N as a separation pinch portion. When a plurality of sheets S is conveyed by the feed roller 41 from the sheet supplying cassette 3, the sheets S are separated at the separation nip portion N, and only one sheet S is conveyed. The sheet supplying cassette 3 includes a stacking plate 30 on which the sheets S are stacked, and the stacking plate 30 can be lifted by receiving driving force of a driving source (not illustrated) up to where a surface of the topmost sheet S comes into contact with the feed roller 41. After the stacking plate 30 is lifted and the sheet S comes into contact with the feed roller 41, the feed roller 41 rotates. As a result, the sheet S is conveyed to the separation nip portion N.

The feed roller 41 and the conveyance roller 42 can rotate by receiving driving force of a driving source (not illustrated). When the feed roller 41 is into contact with the topmost sheet S stacked on the stacking plate 30, the feed roller 41 is urged with predetermined pressure by an urging unit such as a spring (not illustrated).

In addition, the feed unit 4 includes a first sheet detection member 44 that can move when coming into contact with a sheet S. The feed unit 4 also includes a sensor (not illustrated) that can sense rotation of the first sheet detection member 44. When the first sheet detection member 44 comes into contact with a sheet S stacked on the stacking plate 30 and moves upward in FIG. 2, the sensor senses the movement of the first sheet detection member 44. In this way, the location of the topmost sheet S stacked on the stacking plate 30 can be sensed. Based on the sensed location of the topmost sheet S, the stacking plate 30 is lifted by the driving force of the driving source (not illustrated), and the location of the topmost sheet S is maintained in a range where the feed roller 41 can feed the sheet S.

Figure 3A:
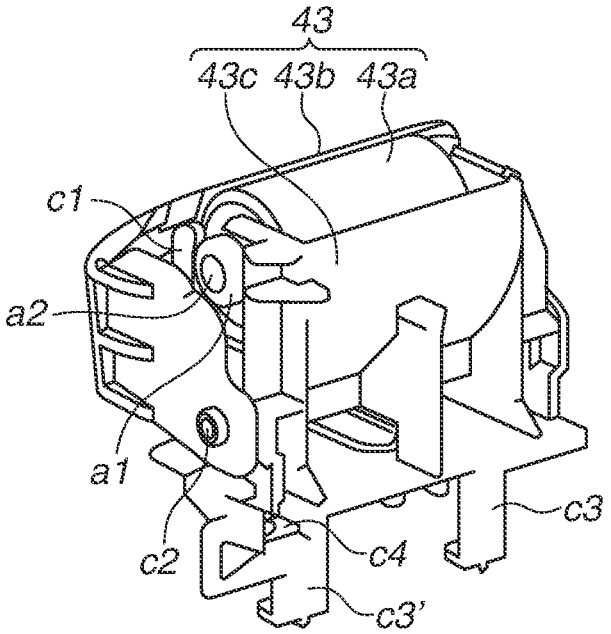
FIG. 3A schematically illustrates a separation unit when a separation member is attached thereto.
Figure 3B:
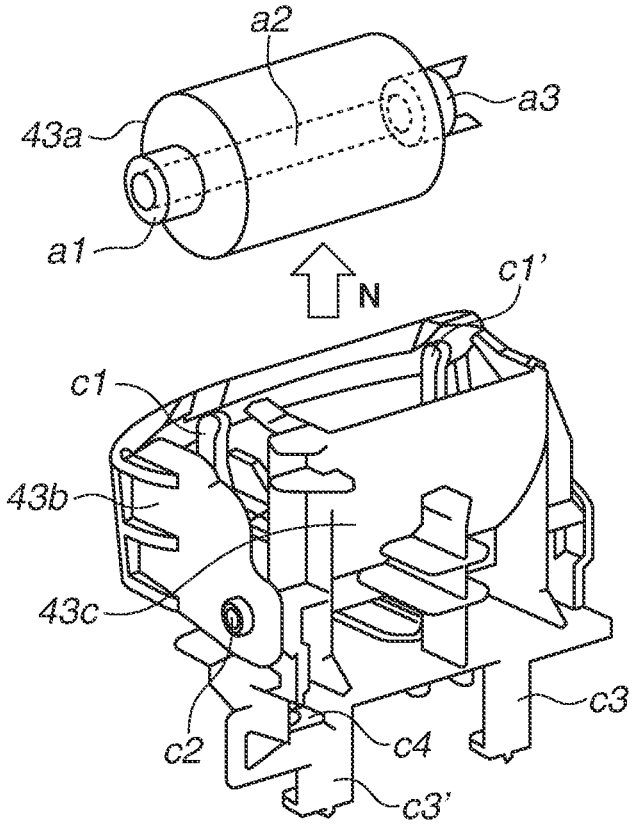
FIG. 3B schematically illustrates the separation unit when the separation member is removed therefrom.

Next, a configuration of the separation unit 43 will be described with reference to FIGS. 3A and 3B. FIG. 3A schematically illustrates the separation unit 43 when the retard roller 43*a* is attached thereto. FIG. 3B schematically illustrates the separation unit 43 when the retard roller 43*a* is removed therefrom.

As illustrated in FIG. 3A, the retard roller 43*a* and the separation nip guide 43*b* are integrated in the holder 43*c* of the separation unit 43. The retard roller 43*a* has a shaft portion a1 on a side thereof, and the shaft portion a1 is rotatably and detachably held by a holding portion c1 of the holder 43*c*. The separation nip guide 43*b* is fitted with a shaft portion c2 arranged on a side of the holder 43*c* and is supported vertically swingably.

In addition, as illustrated in FIG. 3B, the retard roller 43*a* includes a through-hole a2 that runs through the center axis of the rotation of the retard roller 43*a*. The retard roller 43*a* also includes a shaft portion a3 on the side opposite to the shaft portion a1. As with the shaft portion a1, the shaft portion a3 is rotatably and detachably held by a holding portion c1' of the holder 43*c*. The separation nip guide 43*b* is arranged vertically swingably so that an end of a sheet S fed by the feed roller 41 is guided to the separation nip portion N.

When a sheet S is conveyed by the conveyance roller 42 and the separation unit 43, the retard roller 43*a* is supported by a retard roller support shaft 23 inserted into the through-hole a2, and the retard roller 43*a* is urged against the conveyance roller 42. In this state, when the retard roller 43*a* is lifted in the direction indicated by an arrow N in FIG. 3B by the retard roller support shaft 23, the shaft portions a1 and a3 are separated from the respective holding portions c1 and c1'. Consequently, the retard roller 43*a* is separated from the holder 43*c*. When the retard roller 43*a* is lifted by the retard roller support shaft 23 and is urged against the conveyance roller 42, space is formed in the holder 43*c*. In this space, the holding portions c1 and c1' do not interfere with the shaft portions a1 and a3.

To remove the retard roller 43*a* from the holder 43*c*, first, the retard roller 43*a* is pulled in the direction indicated by the arrow N. Consequently, the shaft portions a1 and a3 come into contact with the upper ends of the holding portions c1 and c1', respectively, in the direction indicated by the arrow N. When the retard roller 43*a* is pulled further in the direction indicated by the arrow N, the holding portions c1 and c1' are elastically deformed, and the retard roller 43*a* can be removed from the holder 43*c*. Thus, the retard roller 43*a* is detachably held in the holder 43*c* in such a manner that the retard roller 43*a* is not easily detached from the holder 43*c* even when the separation unit 43 is turned upside down. The holder 43*c* is made of synthetic resin by using injection molding.

Figure 4A:
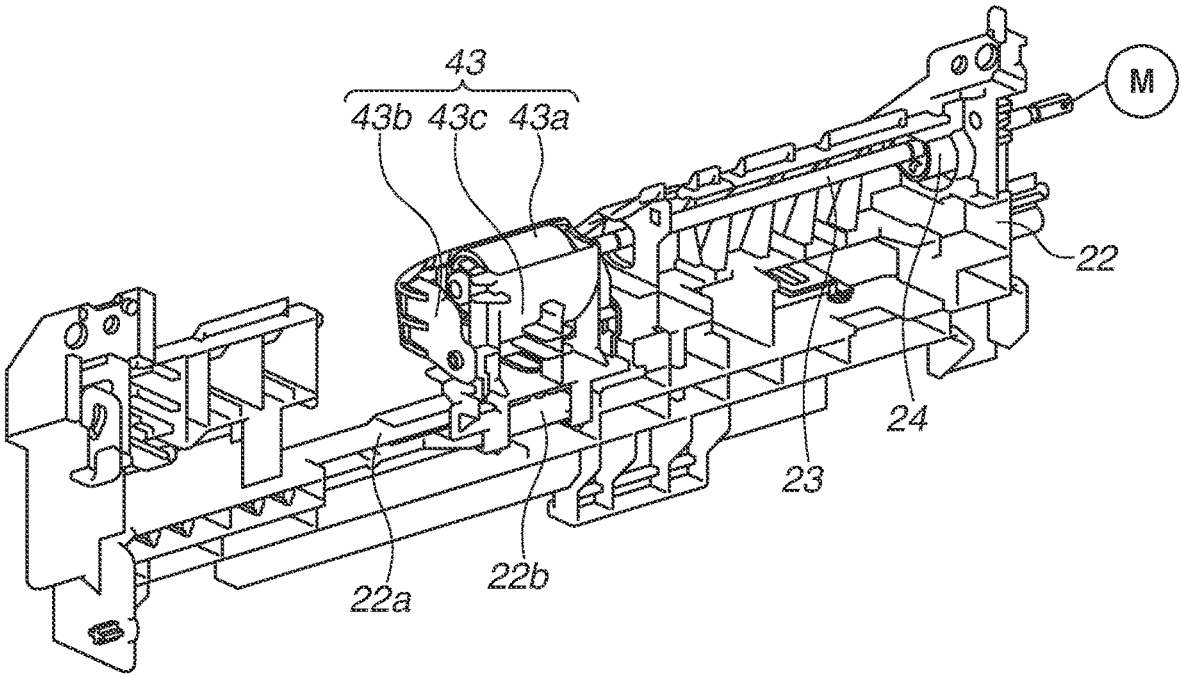
FIG. 4A schematically illustrates the separation unit seen from a downstream side in the sheet conveyance direction according to the first embodiment.

Next, an operation of separating sheets S by the separation unit 43 will be described with reference to FIGS. 4A and 4B and FIGS. 5A and 5B. FIG. 4A schematically illustrates the separation unit 43 of the feed unit 4 seen from the downstream side in the sheet conveyance direction. As illustrated in FIG. 4A, the retard roller 43*a* of the separation unit 43 according to the present embodiment is rotatably supported by the retard roller support shaft 23 of the feed unit 4. The retard roller support shaft 23 is inserted into the through-hole a2 of the retard roller 43*a*. The retard roller support shaft 23 has two ends in its axial direction. One of the ends is fixed to a frame 22, which is a main body of the feed unit 4, and the other end is a free end that is not fixed to the frame 22. In other words, the retard roller support shaft 23 is a support shaft having one end attached to the frame 22. A torque limiter 24 is arranged at the fixed end of the retard roller support shaft 23, and a motor M as a driving source is connected to the retard roller support shaft 23 via the torque limiter 24.

Figure 4B:
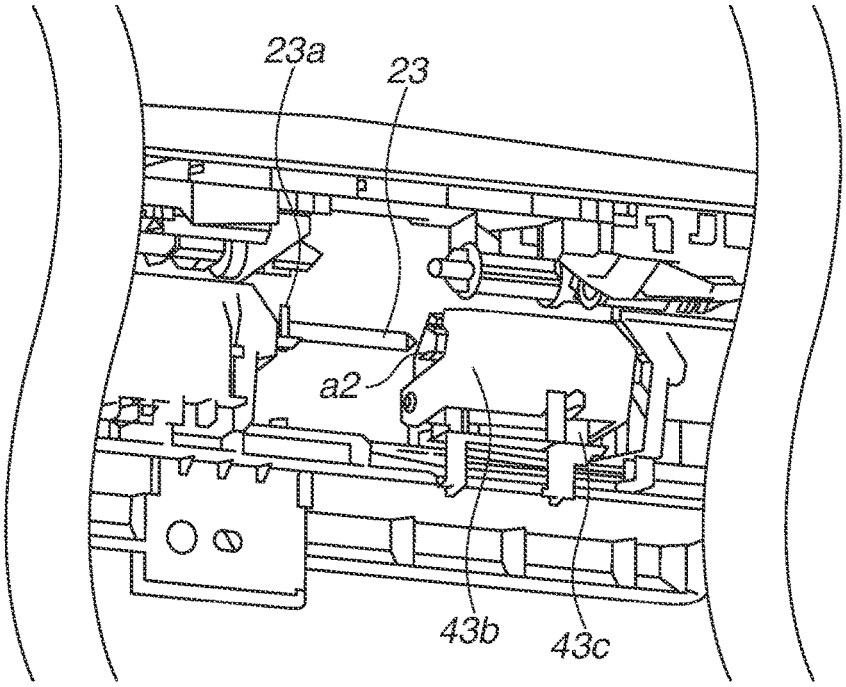
FIG. 4B schematically illustrates the separation unit seen from an upstream side in the sheet conveyance direction according to the first embodiment.

FIG. 4B schematically illustrates the separation unit 43 of the feed unit 4 seen from the upstream side in the sheet conveyance direction before the retard roller support shaft 23 is inserted into the through-hole a2 of the retard roller 43*a*. As illustrated in FIG. 4B, the retard roller support shaft 23 has a protruding portion 23*a* and can be inserted into the through-hole a2 that runs from the shaft portion a1 to the shaft portion a3 of the retard roller 43*a*. When the retard roller support shaft 23 is inserted into the through-hole a2, the retard roller 43*a* is supported by the retard roller support shaft 23, and the protruding portion 23*a* engages with a groove of the shaft portion a3. In this way, when the retard roller support shaft 23 rotates by the driving force from the motor M, the retard roller 43*a* can rotate with the retard roller support shaft 23.

Based on a signal for feeding a sheet S, the feed roller 41 and the conveyance roller 42 start to rotate (forward rotation) in a direction in which the sheet S is conveyed to the image forming unit 5, and the retard roller 43*a* starts to rotate by the driving force transferred from the retard roller support shaft 23. While the retard roller support shaft 23 normally receives the driving force that rotates (forward rotation) the retard roller support shaft 23 in the same direction as that of the rotation of the conveyance roller 42, the torque limiter 24 changes the rotation direction of the retard roller 43*a*, depending on the sheet pinching state at the separation nip portion N. Hereinafter, the rotation direction of the retard roller 43*a* will be described with reference to FIGS. 5A and 5B.

Figure 5A:
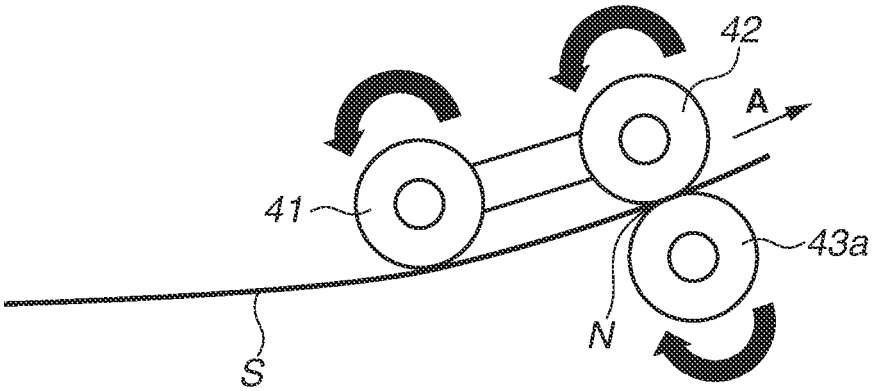
FIG. 5A schematically illustrates a sheet conveyance operation performed when a single sheet is conveyed to a separation nip portion according to the first embodiment.
Figure 5B:
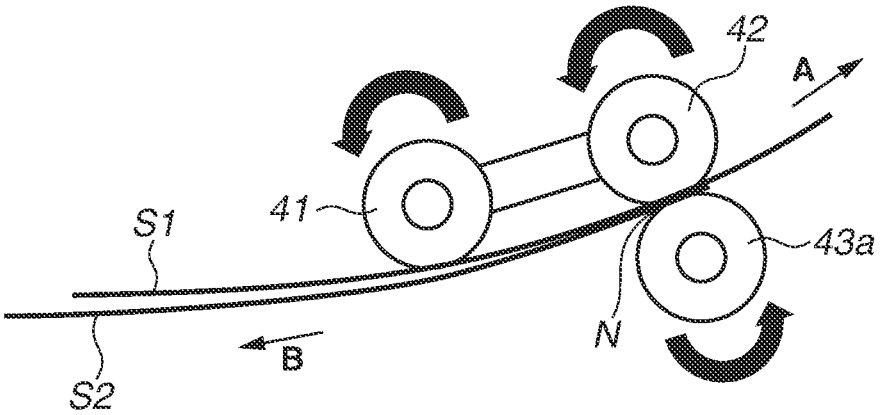
FIG. 5B schematically illustrates a sheet conveyance operation performed when a plurality of sheets is conveyed with overlaps to the separation nip portion according to the first embodiment.

FIG. 5A schematically illustrates an operation performed when the separation unit 43 conveys a single sheet S. FIG. 5B schematically illustrates an operation performed when the separation unit 43 separates and conveys sheets S1 and S2 that have been conveyed with overlaps.

As illustrated in FIG. 5A, when the single sheet S is pinched at the separation nip portion N, because of the frictional force that occurs between the retard roller 43*a* and the sheet S, the torque limiter 24 cuts off the transfer of the driving force from the retard roller support shaft 23. As a result, the retard roller 43*a* rotates with the rotation of the conveyance roller 42 via the sheet S being conveyed, and the sheet S at the separation nip portion N is conveyed in the direction indicated by an arrow A in FIG. 5A. In FIG. 5A, the retard roller 43*a* rotates (reverse rotation) in the direction opposite to the rotation direction of the conveyance roller 42. When no sheet S is pinched at the separation nip portion N, because of the frictional force that occurs between the retard roller 43*a* and the conveyance roller 42, the retard roller 43*a* rotates with the rotation of the conveyance roller 42.

In contrast, when sheets S are fed with overlaps by the feed roller 41 and a plurality of sheets S is pinched at the separation nip portion N, the separation unit 43 separates the sheets S and conveys only one sheet S as follows. The following case assumes that a first sheet S1 and a second sheet S2 are pinched at the separation nip portion N, as illustrated in FIG. 5B. In this case, the frictional force that occurs between the first sheet S1 and the second sheet S2 is relatively smaller than the frictional force that occurs between the sheet S and the retard roller 43*a* illustrated in FIG. 5A. Thus, the torque limiter 24 does not cut off the transfer of the driving force from the retard roller support shaft 23, and the retard roller 43*a* rotates (forward rotation) in the same direction as the rotation direction of the conveyance roller 42. Thus, the first sheet S1 on the conveyance roller 42 is conveyed by the rotation of the conveyance roller 42 in the direction indicated by an arrow A in FIG. 5B, and the second sheet S2 on the retard roller 43*a* is conveyed by the rotation of the retard roller 43*a* in the direction indicated by an arrow B in FIG. 5B. As a result, an end of the second sheet S2 is returned to the upstream side of the separation nip portion N.

The retard roller 43*a* wears down and deteriorates as it separates and conveys the sheets S. Consequently, the friction coefficient of the retard roller 43*a* is decreased. When the retard roller 43*a* deteriorates, the performance of separating the sheets S may be decreased. Accordingly, a user or a serviceperson (hereinafter, referred to as a user) needs to replace the retard roller 43*a* regularly.

[Replacement of Retard Roller]

Figure 6:
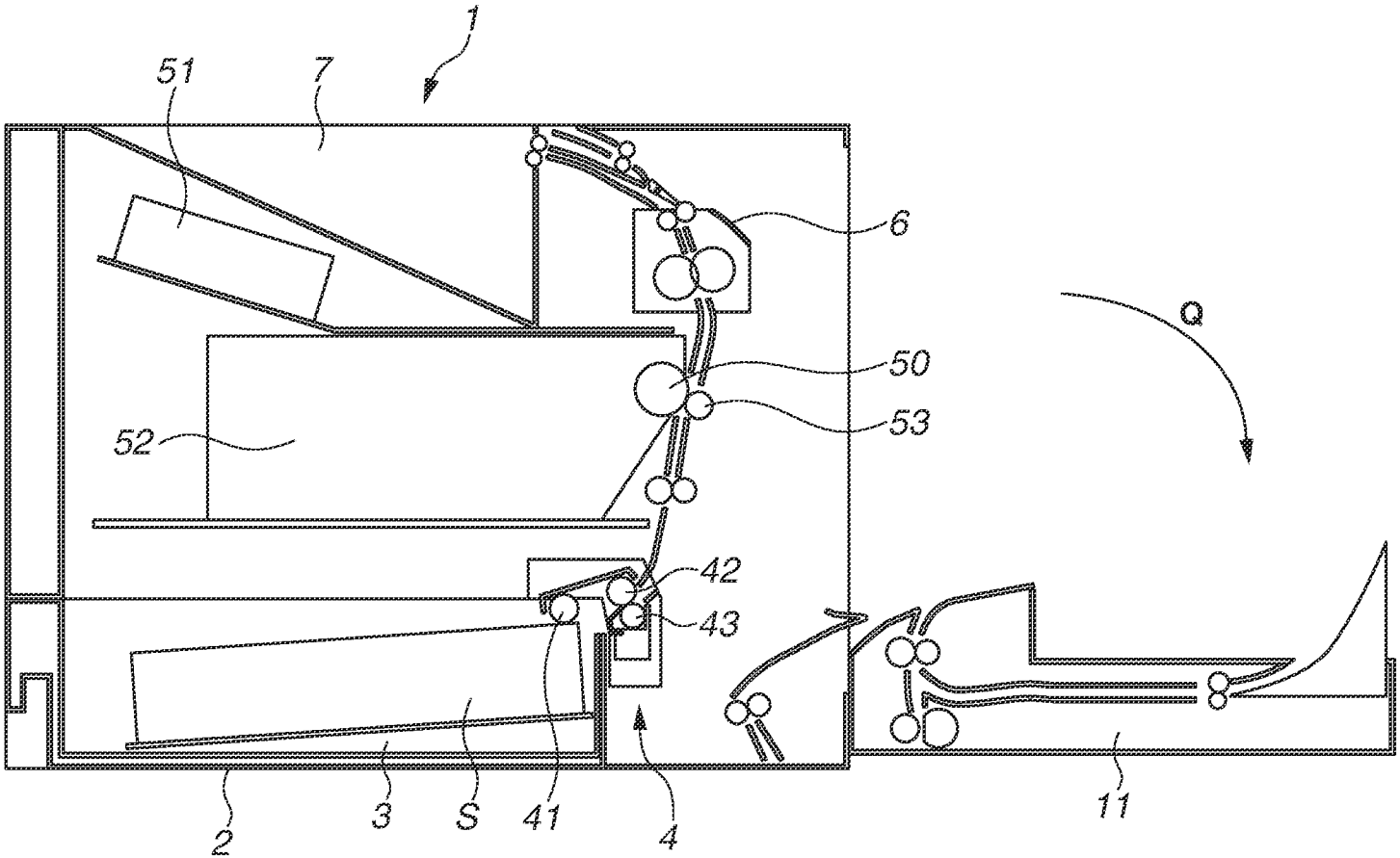
FIG. 6 is a schematic cross section illustrating a configuration of the image forming apparatus when an access door is opened according to the first embodiment.

Next, replacement of the retard roller 43*a* according to the present embodiment will be described with reference to FIGS. 6 to 9. FIG. 6 is a schematic cross section illustrating the image forming apparatus 1 having an access door 11 as an opening and closing member opened. As illustrated in FIG. 6, when replacing the retard roller 43*a*, the user can view the separation unit 43 by opening the access door 11 attached to a main body of the image forming apparatus 1 in the direction indicated by an arrow Q in FIG. 6. When a sheet S is jammed in the image forming apparatus 1, the user can handle the jam by opening the access door 11. In addition, by opening the access door 11, the user can perform maintenance of the image forming unit 5, for example.

Figure 7:
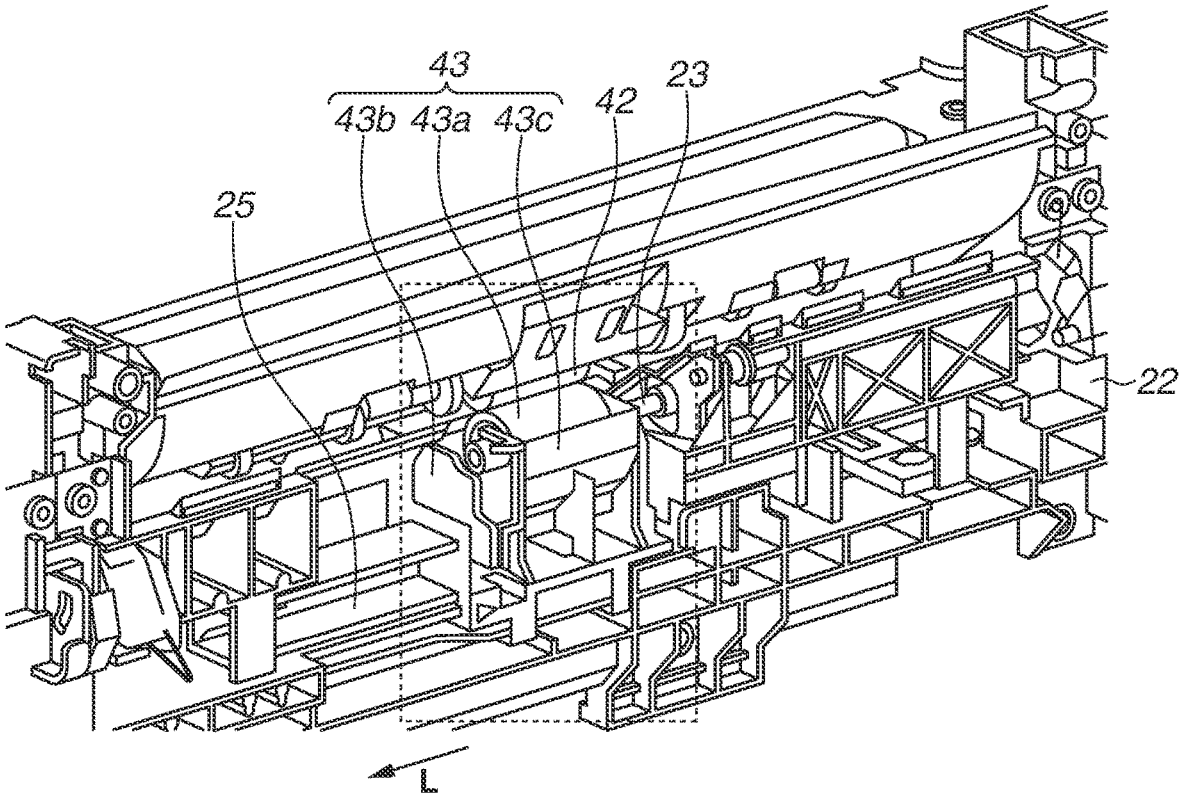
FIG. 7 schematically illustrates the feed unit before the separation unit is removed according to the first embodiment.
Figure 8:
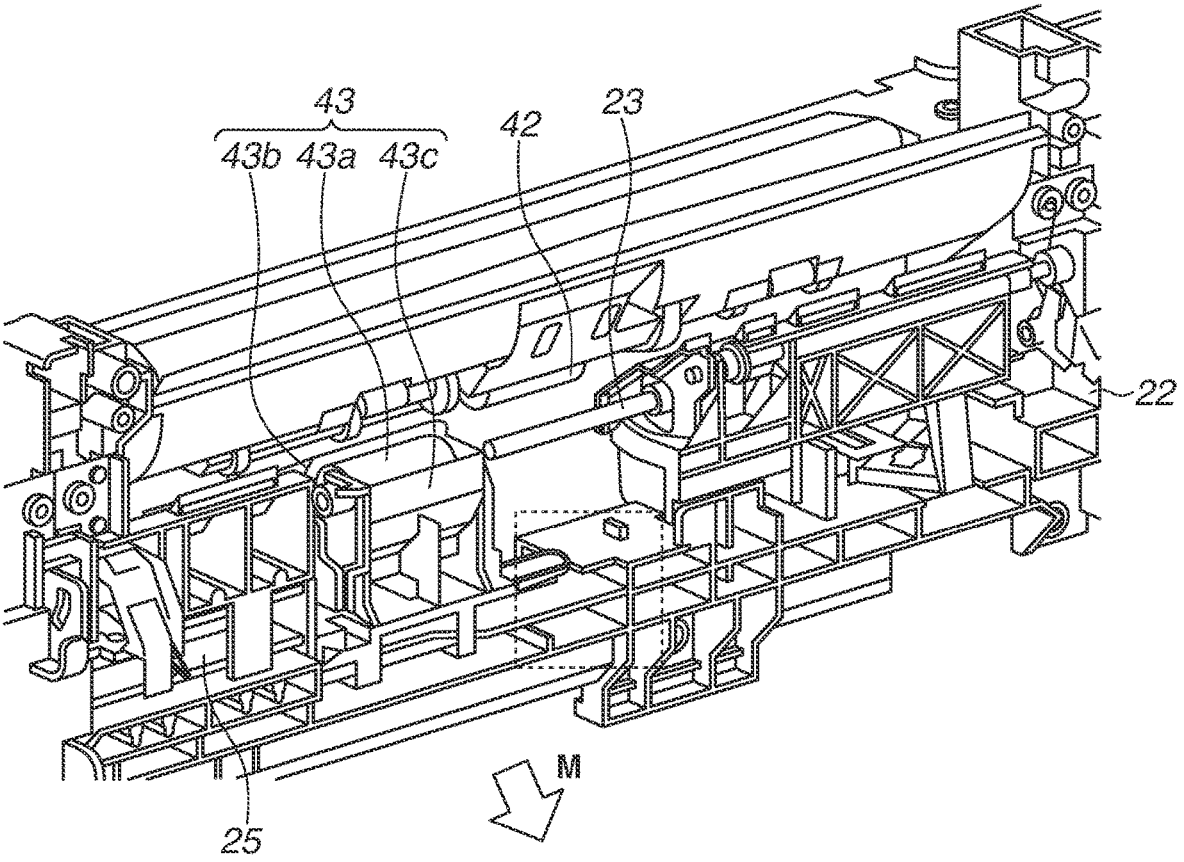
FIG. 8 schematically illustrates the feed unit after the separation unit is slid according to the first embodiment.
Figure 9:
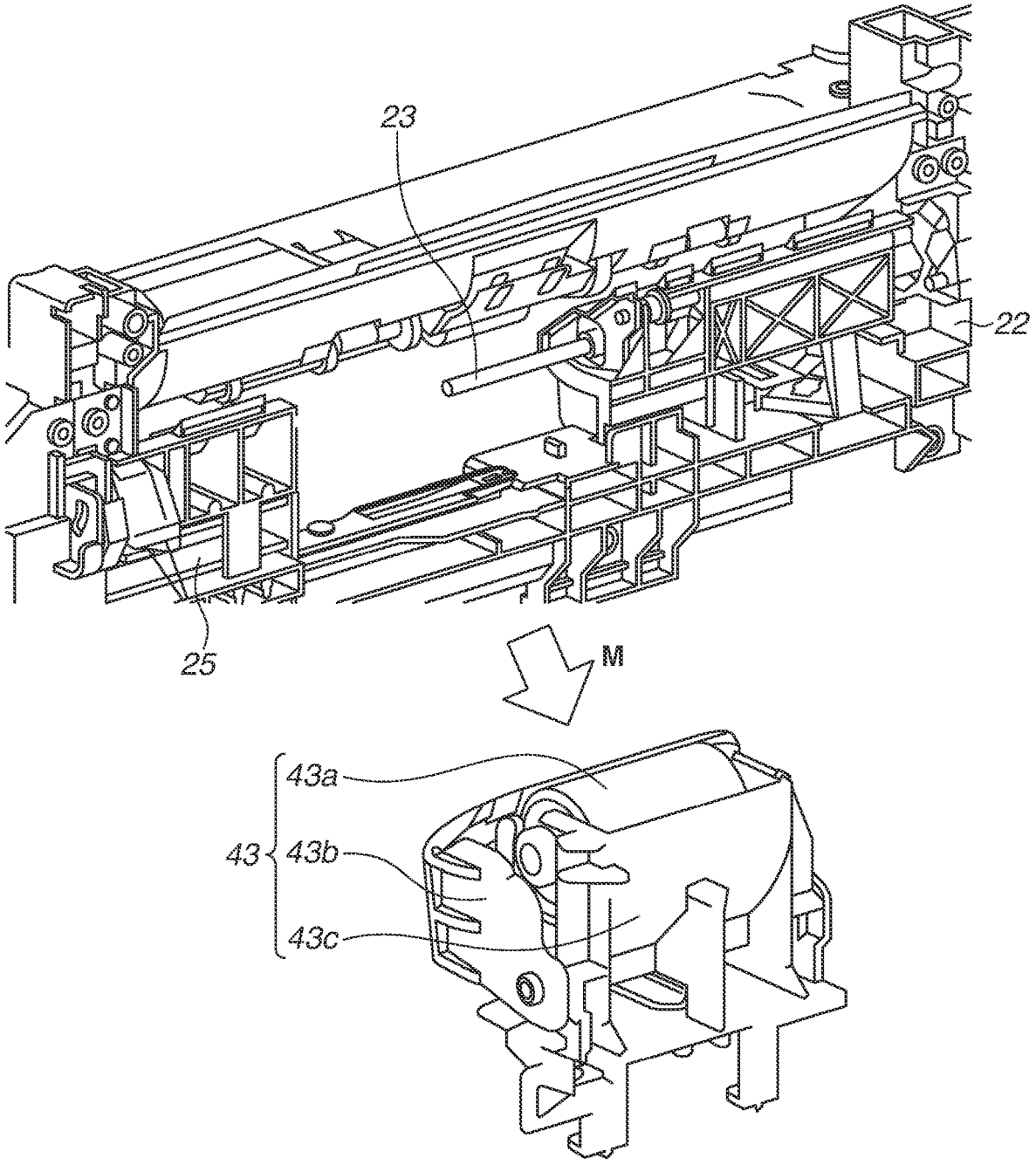
FIG. 9 schematically illustrates the feed unit after the separation unit is removed according to the first embodiment.

FIGS. 7 to 9 schematically illustrate an operation of removing the separation unit 43 from the feed unit 4. FIG. 7 schematically illustrates the feed unit 4 before the separation unit 43 is removed from the feed unit 4. FIG. 8 schematically illustrates the feed unit 4 after the separation unit 43 is slid from the retard roller support shaft 23. FIG. 9 schematically illustrates the feed unit 4 after the separation unit 43 is removed from the feed unit 4.

In FIG. 7, the retard roller 43*a* is rotatably supported by the retard roller support shaft 23, and the separation unit 43 is fixed to the frame 22. In the present embodiment, the user replaces the retard roller 43*a* by removing the separation unit 43 from the feed unit 4 first and by removing the retard roller 43*a* from the separation unit 43 next.

As illustrated in FIG. 7, when removing the separation unit 43 from the feed unit 4, first, the user holds the holder 43*c* and slides the separation unit 43 in a direction (the direction indicated by an arrow L in FIG. 7) from the fixed end to the free end of the retard roller support shaft 23. When the user slides the separation unit 43, a guide 25 as a guiding member neighboring the separation unit 43 also moves in the direction indicated by the arrow L along with the separation unit 43. The feed unit 4 is provided with the guide 25. More specifically, the guide 25 is attached to the frame 22 in such a manner that the guide 25 can move in the direction indicated by the arrow L, to guide a sheet S fed by the feed roller 41 to the downstream side in the sheet conveyance direction.

Next, a configuration of slidably supporting the separation unit 43 will be described. As illustrated in FIGS. 4A and 4B, the separation unit 43 can be held by the frame 22, and the holder 43*c* can slide along an upper guide portion 22*a* of the frame 22. In addition, as illustrated in FIGS. 3A and 3B, the holder 43*c* of the separation unit 43 has engaging portions c3 and c3', which can engage with a lower guide portion 22*b* formed in parallel with the upper guide portion 22*a* of the frame 22. With this configuration, the separation unit 43 is slidably supported by the frame 22. The frame 22 is made of synthetic resin by using injection molding.

When the user slides the separation unit 43 in the direction indicated by the arrow L in FIG. 7, as illustrated in FIG. 8, the retard roller support shaft 23 is pulled out of the through-hole a2 of the retard roller 43*a*, and the separation unit 43 is moved to the space created by the movement of the guide 25. In this state, the retard roller 43*a* is not supported by the retard roller support shaft 23, and the separation unit 43 is not fixed to the frame 22, either. Thus, by pulling the holder 43*c* in the near direction (in the direction indicated by an arrow M in FIG. 8), the user can remove the separation unit 43 from the feed unit 4. As illustrated in FIG. 9, the retard roller 43*a*, the separation nip guide 43*b*, and the holder 43*c* are removed all together as the separation unit 43 from the feed unit 4.

As illustrated in FIG. 3A, when the retard roller 43*a* is placed in the separation unit 43, the shaft portion a1 of the retard roller 43*a* is rotatably and detachably held by the holding portion c1, and the retard roller 43*a* is held in the space formed by the separation nip guide 43*b* and the holder 43*c*. Accordingly, as illustrated in FIG. 3A, the user can remove the retard roller 43*a* from the separation unit 43 by removing the retard roller 43*a* from the space formed by the separation nip guide 43*b* and the holder 43*c* in the direction indicated by the arrow N in FIG. 3B.

In addition, in the present embodiment, when a new retard roller 43*a* is attached to the separation unit 43, the user places the new retard roller 43*a* in the space formed by the separation nip guide 43*b* and the holder 43*c* by holding the shaft portions a1 and a3 on the sides of the new retard roller 43*a*. An elastic portion such as rubber is formed on the surface of the retard roller 43*a*, and the retard roller 43*a* may be deteriorated by sebum of the user. Thus, when the user replaces an old retard roller 43*a* by a new retard roller 43*a*, the user should avoid touching the elastic portion of the new retard roller 43*a* as much as possible. By attaching the new retard roller 43*a* to the separation unit 43 while holding the shaft portions a1 and a3 on the sides of the new retard roller 43*a*, the user can avoid touching the elastic portion of the new retard roller 43*a*. Other than rubber, for example, urethane or sponge can be used for the elastic portion formed on the surface of the retard roller 43*a*. The above description is also applied to these cases.

When the user attaches the separation unit 43, to which a new retard roller 43*a* has been attached, to the feed unit 4, the user can do the opposite of the above operation of removing the separation unit 43. More specifically, by using the space created by the movement of the guide 25 upon removal of the separation unit 43, the user places the separation unit 43 on the upper guide portion 22*a* of the frame 22. Next, the user slides the separation unit 43 in the direction opposite to the direction indicated by the arrow L in FIG. 7 by holding the holder 43*c*. In this way, the retard roller support shaft 23 is inserted into the through-hole a2 of the retard roller 43*a*, and the retard roller 43*a* is supported by the retard roller support shaft 23.

As described above, according to the present embodiment, by sliding the separation unit 43, the user can integrally attach and detach the retard roller 43*a*, the separation nip guide 43*b*, and the holder 43*c* as the separation unit 43 to and from the feed unit 4. With this configuration, the user can easily replace the retard roller 43*a*. Accordingly, the replacement performance of the retard roller 43*a* can be refined.

In addition, according to the present embodiment, the user can attach and detach the retard roller 43*a* to and from the separation unit 43 by holding the shaft portions a1 and a3 formed on the sides of the retard roller 43*a*. In this way, when the user replaces the retard roller 43*a*, a hand of the user does not touch the elastic portion of the new retard roller 43*a*. Thus, deterioration of the new retard roller 43*a* can be prevented.

The present embodiment has been described based on an example in which the user first removes the separation unit 43 from the feed unit 4 and next replaces the retard roller 43*a*. However, the user may remove an old separation unit 43 from the feed unit 4 to replace it by a new separation unit 43. As described above, since the user can attach and detach the separation unit 43 to and from the feed unit 4 when replacing the retard roller 43*a*, a hand of the user does not touch the elastic portion of the new retard roller 43*a*.

In addition, the present embodiment has been described assuming that the user holds the shaft portions a1 and a3 of the retard roller 43*a* when attaching and detaching the retard roller 43*a* to and from the separation unit 43. However, the user may hold other portions, as long as the user does not touch the elastic portion of the retard roller 43*a*. For example, the user may attach and detach the retard roller 43*a* to and from the separation unit 43 by holding resin portions on the sides of the retard roller 43*a*.

Figure 10A:
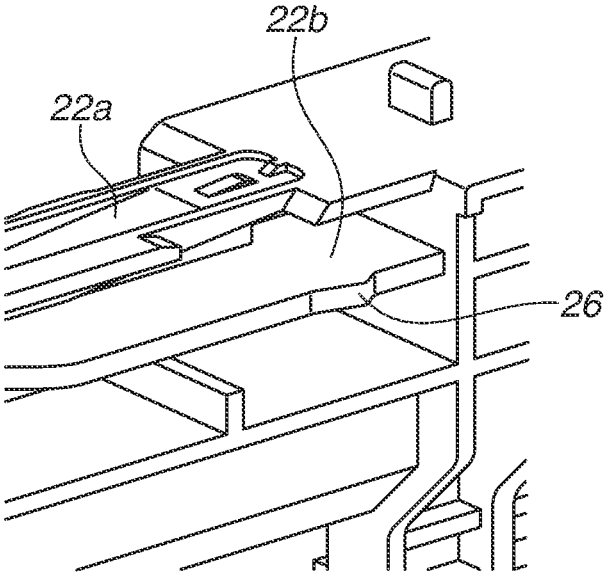
FIG. 10A schematically illustrates a protruding portion formed on a main body of the feed unit to fix the separation unit according to the first embodiment.
Figure 10B:
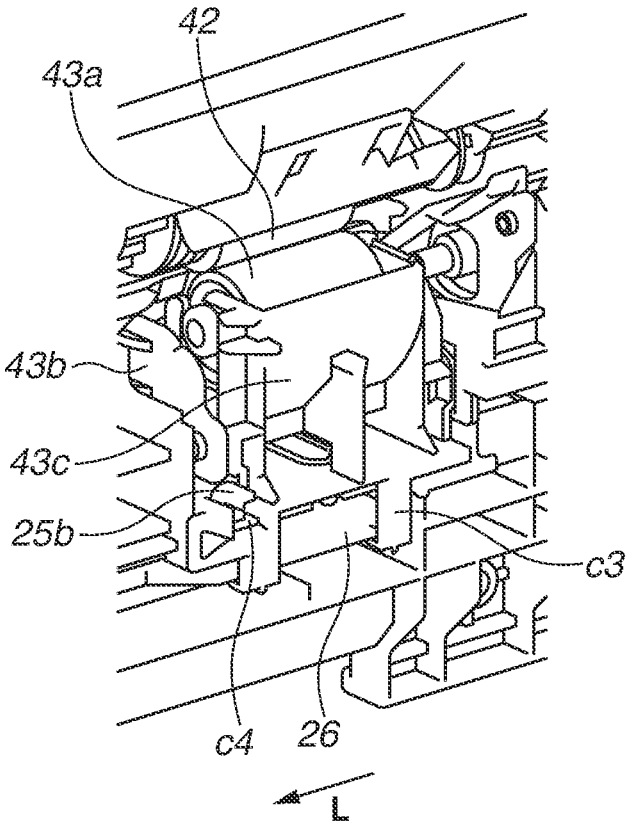
FIG. 10B schematically illustrates a state where the separation unit is fixed to the feed unit according to the first embodiment.

Next, a configuration of a fixing portion that fixes the separation unit 43 attached to the feed unit 4 to the feed unit 4 will be described with reference to FIGS. 3A, 10A, and 10B. FIG. 10A is a schematic enlarged view of a portion indicated by a dotted line in FIG. 8, in a state where the separation unit 43 is not yet attached to the feed unit 4. FIG. 10B is a schematic enlarged view of a portion indicated by a dotted line in FIG. 7, in a state where the separation unit 43 is fixed to the feed unit 4.

The holder 43*c* of the separation unit 43 has the engaging portion c3 as illustrated in FIG. 3A, and an end portion of the lower guide portion 22*b* of the frame 22 of the feed unit 4 has a protruding portion 26 as an engaged portion that engages with the engaging portion c3 as illustrated in FIG. 10A. As illustrated in FIG. 10B, when the separation unit 43 is slid and attached to the feed unit 4, the engaging portion c3 elastically deforms as the engaging portion c3 moves over the protruding portion 26 and engages with the protruding portion 26. As a result, the separation unit 43 is fixed to the lower guide portion 22*b* of the frame 22 of the feed unit 4. When removing the separation unit 43 from the feed unit 4, the user slides the separation unit 43 in the direction indicated by an arrow L in FIG. 10B by holding the holder 43*c*. In this way, the engaging portion c3 moves over the protruding portion 26, and thus, the above engagement is released.

Consequently, the separation unit 43 is detached from the feed unit 4. In this way, the separation unit 43 can be fixed to the frame 22 of the feed unit 4.

The fixing portion may have a different configuration. For example, the lower guide portion 22*b* may be provided with a depressed portion as the engaged portion. In this case, when the engaging portion c3 elastically deforms and moves in the depressed portion, the separation unit 43 is fixed to the feed unit 4. The fixing portion may have any configuration, as long as the user can fix the separation unit 43 to the frame 22 by sliding the separation unit 43.

Next, a configuration in which the guide 25 moves with the separation unit 43 will be described. As illustrated in FIG. 3A, the holder 43*c* of the separation unit 43 according to the present embodiment has a fitting portion c4 on the side that comes into contact with the guide 25 when the separation unit 43 is attached to the feed unit 4. In addition, as illustrated in FIG. 10B, the guide 25 has a fitted portion 25*b* that can fit with the fitting portion c4 on the side that comes into contact with the separation unit 43 when the separation unit 43 is attached to the feed unit 4. According to the present embodiment, when attaching the separation unit 43 to the feed unit 4, the user fits the fitted portion 25*b* of the guide 25 with the fitting portion c4 and slides the separation unit 43 in the direction opposite to the direction indicated by the arrow L in FIGS. 7 and 10B. As a result, the guide 25 also moves with the separation unit 43, and when the separation unit 43 is fixed to the feed unit 4, the guide 25 is also fixed to the feed unit 4 as illustrated in FIG. 10B. More specifically, by fitting the fitted portion 25*b* of the guide 25 with the fitting portion c4 of the holder 43*c*, the user can attach the separation unit 43 to the feed unit 4 and position the guide 25.

In addition, when the user slides the separation unit 43 in the direction indicated by the arrow L in FIGS. 7 and 10B to remove the separation unit 43 from the feed unit 4, since the fitting portion c4 is fitted with the fitted portion 25*b*, the guide 25 moves with the separation unit 43. In this way, the user does not need to move the guide 25 manually. By performing the operations of attaching and detaching the separation unit 43, the user can ensure the space for removing the separation unit 43 and move the guide 25 to the guide position of the sheets S.

A different configuration may be used to move the guide 25 with the separation unit 43. For example, a hole may be provided in the guide 25 as a fitting portion, and a protruding portion may be provided on the holder 43*c* of the separation unit 43 as a fitted portion that fits with the fitting portion of the guide 25. With this configuration, as with the above configuration according to the present embodiment, by fitting the hole with the protruding portion, the guide 25 can move with the separation unit 43. Any configuration of coupling the guide 25 and the separation unit 43 may be used, as long as the guide 25 moves with the separation unit 43.

While the separation unit 43 and the guide 25 are configured to move together according to the present embodiment, the embodiments are not limited to this configuration. The user may slide the guide 25 in the direction opposite to the direction indicated by the arrow L in FIGS. 7 and 10B after the separation unit 43 is attached to the feed unit 4. In this case, for example, by additionally arranging fixing the guide 25 to the frame 22 of the feed unit 4 or to the separation unit 43, the positioning of the guide 25 can be achieved.

Regarding the movement of the guide 25, the user may manually move the guide 25 in the direction indicated by the arrow L in FIGS. 7 and 10B and in the opposite direction thereof. Alternatively, the guide 25 may be configured to move in conjunction with the operations of attaching and detaching the sheet supplying cassette 3 to the image forming apparatus 1. In the latter case, the guide 25 moves in the direction indicated by the arrow L in FIGS. 7 and 10B in conjunction with the operation of detaching the sheet supplying cassette 3 from the image forming apparatus 1. In this way, the user does not need to manually move the guide 25. More specifically, by pulling the sheet supplying cassette 3 from the image forming apparatus 1, the user can ensure the space for sliding and removing the separation unit 43. In addition, when the user attaches the sheet supplying cassette 3 to the image forming apparatus 1 after attaching the separation unit 43 to the feed unit 4, the guide 25 moves in the opposite direction to the direction indicated by the arrow L in FIGS. 7 and 10B in conjunction with this operation of attaching the sheet supplying cassette 3 to the image forming apparatus 1.

According to the present embodiment, the motor M as a driving source is connected to the retard roller support shaft 23 via the torque limiter 24, and when the retard roller support shaft 23 rotates upon receiving the driving force transferred from the motor M, the retard roller 43*a* rotates along with the retard roller support shaft 23. However, the embodiments are not limited to this configuration. The motor M as a driving source may not be connected to the retard roller support shaft 23. In this case, because of the torque limiter 24 arranged at the fixed end of the retard roller support shaft 23, when no sheet S is pinched at the separation nip portion N and when the conveyance roller 42 is not rotated, the retard roller 43*a* is not rotated and is stopped at the separation nip portion N.

Thus, when a single sheet S is pinched at the separation nip portion N, since the retard roller 43*a* receives the driving force from the conveyance roller 42 via the sheet S, the frictional force that occurs between the retard roller 43*a* and the sheet S is increased. Thus, the retard roller 43*a* rotates with the rotation of the conveyance roller 42, and the sheet S at the separation nip portion N is conveyed toward the image forming unit 5. In contrast, when two sheets S are fed with overlaps by the feed roller 41 to the separation nip portion N, the frictional force that occurs between the two sheets S is relatively smaller than the frictional force that occurs when a single sheet S is pinched at the separation nip portion N. Thus, since the retard roller 43*a* does not rotate, the sheet S on the conveyance roller 42 is conveyed toward the image forming unit 5, and the sheet S on the retard roller 43*a* is not conveyed but stopped at the separation nip portion N.

When the motor M as a driving source is not connected to the retard roller support shaft 23, sheets S can be separated in accordance with the above operation at the separation nip portion N with a simple configuration. The torque limiter 24 may be arranged inside the retard roller 43*a*. Alternatively, the torque limiter 24 is not necessarily arranged at the retard roller support shaft 23.

The present embodiment has been described assuming that the user replaces the retard roller 43*a* by removing the separation unit 43 from the feed unit 4 first and removing the retard roller 43*a* from the separation unit 43 next. However, the embodiments are not limited to such configuration. The present invention is applicable to any roller that easily deteriorates by abrasion and needs to be replaced, as the retard roller 43*a* does. By arranging a mechanism for attaching and detaching a holder that holds such a roller, as in the present embodiment, beneficial effects similar to those according to the present embodiment can be obtained.

Figure 11A:
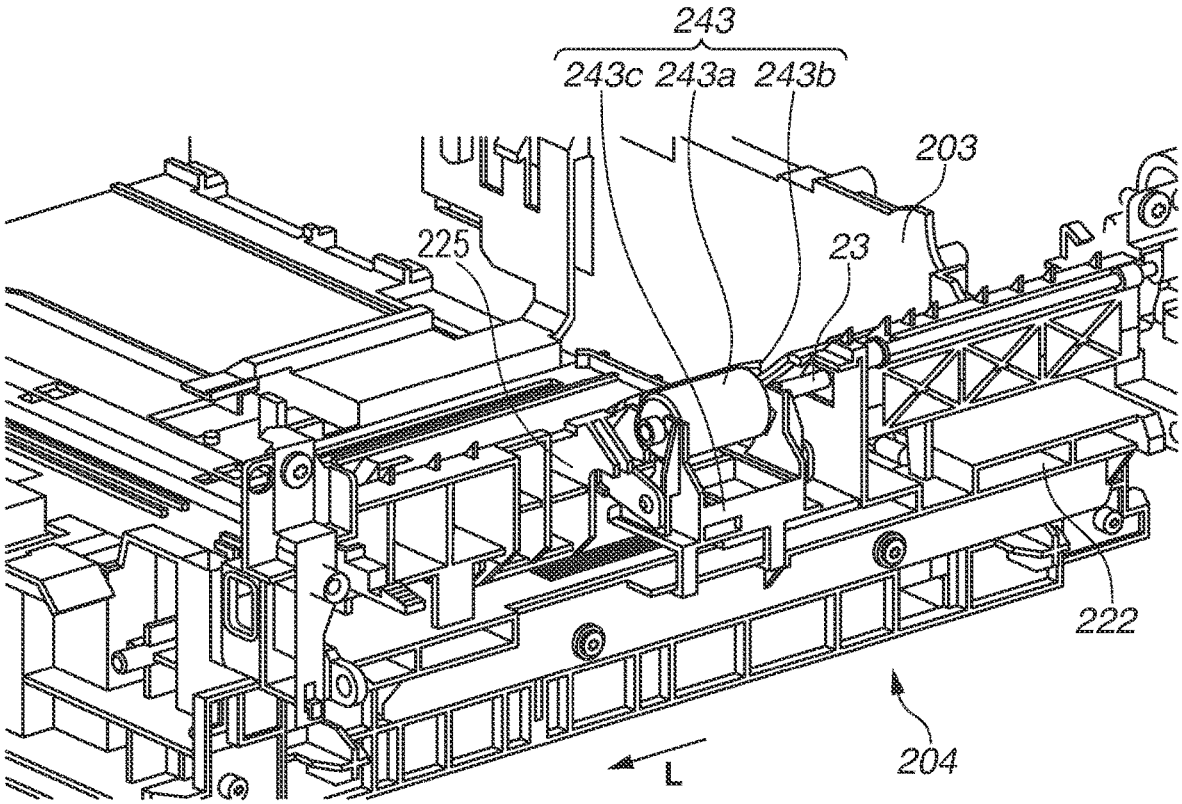
FIG. 11A schematically illustrates a configuration of a feed unit and a sheet supplying cassette according to a different embodiment.
Figure 11B:
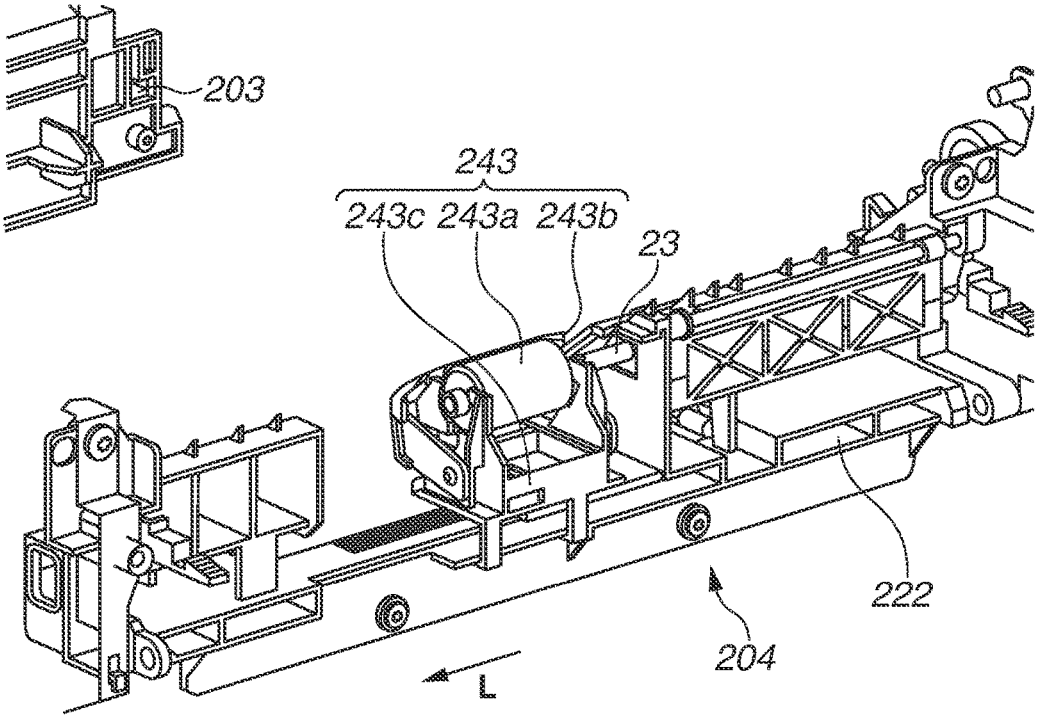
FIG. 11B schematically illustrates the feed unit after the sheet supplying cassette is removed from the corresponding image forming apparatus according to the different embodiment.

According to the first embodiment, the guide 25 as a guiding member of the feed unit 4 is configured to slide. More specifically, when removing the separation unit 43 from the feed unit 4, the user slides the separation unit 43, and the guide 25 is moved in conjunction with the sliding of the separation unit 43. Meanwhile, as illustrated in FIGS. 11A and 11B, a second embodiment differs from the first embodiment in that a guide portion 225 as a guiding member neighboring the separation unit 43 is formed as a part of a sheet supplying cassette 203. The configuration of the present embodiment is similar to that of the first embodiment, except that the guide portion 225 is formed as a part of the sheet supplying cassette 203 and that a separation unit 243 is configured differently from the separation unit 43 of the first embodiment. The similar components will be denoted by the same reference characters, and redundant description thereof will be avoided.

FIG. 11A schematically illustrates a configuration of a sheet supplying cassette 203 and a feed unit 204 according to the present embodiment, and FIG. 11B schematically illustrates the feed unit 204 after the sheet supplying cassette 203 is removed from an image forming apparatus 1 according to the present embodiment.

As illustrated in FIG. 11A, according to the present embodiment, the guide portion 225 neighboring the separation unit 243 is not formed on the feed unit 204 but formed as a part of the sheet supplying cassette 203. Thus, as illustrated in FIG. 11B, when the user pulls the sheet supplying cassette 203 from the image forming apparatus 1, the guide portion 225 is distanced from the feed unit 204. In this way, the space for detaching the separation unit 243 is created, and the user can detach the separation unit 243 from the feed unit 204 by sliding the separation unit 243 in the direction indicated by an arrow L in FIG. 11B.

As described above, according to the present embodiment, only by pulling the sheet supplying cassette 203 from the image forming apparatus 1, the user can ensure the space for sliding the separation unit 243 in the direction indicated by the arrow L in FIG. 11B and detaching the separation unit 243. In addition, by attaching the sheet supplying cassette 203 to the image forming apparatus 1, the guide portion 225 is positioned and fixed to the feed unit 204. Thus, according to the present embodiment, there is no need to additionally arrange fixing the guide portion 225 to a frame 222 of the feed unit 204 or the separation unit 243. In addition, since the guide portion 225 is not moved with the movement of the separation unit 243, there is no need to provide a holder 243*c* with a fitting portion that fits with the guide portion 225. In this way, the user can remove the separation unit 243 from the feed unit 204 with a simple configuration.

As described above, the configuration according to the present embodiment can also provide beneficial effects similar to those provided according to the first embodiment.

The above embodiments have been described based on examples in which the present disclosure is applied to electrophotographic image forming apparatuses. However, the embodiments are not limited to the above embodiments. For example, an embodiment is applicable to non-electrophotographic image forming apparatuses, such as inkjet image forming apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A sheet conveyance apparatus comprising:

a storage unit configured to store a sheet;

a conveyance member configured to convey the sheet;

a support shaft portion having one end as a fixed end that is fixed to a main body of the sheet conveyance apparatus and the other end as a free end that is not fixed to the main body;

a separation unit configured to pinch the sheet with the conveyance member, to convey the pinched sheet with the conveyance member, and to separate, one by one, a plurality of sheets stored in and fed from the storage unit, wherein the separation unit includes a separation member configured to be supported by the support shaft portion and rotatable with the support shaft portion, and includes a holding member holding the separation member in a state where the separation member is not supported by the support shaft portion; and a guiding member that neighbors the separation unit in an axial direction of the support shaft portion and is configured to guide the sheet fed from the storage unit, wherein, by moving the holding member from the fixed end side of the support shaft portion to the free end side of the support shaft portion in the support shaft portion axial direction, the separation unit is removed from the sheet conveyance apparatus with the holding member holding the separation member, and wherein, by moving the holding member from the fixed end side of the support shaft portion to the free end side of the support shaft portion in the support shaft portion axial direction, the guiding member moves in the axial direction together with the separation unit.

2. The sheet conveyance apparatus according to claim 1, wherein the holding member has an engaging portion configured to engage with a protruding portion provided to the main body, and wherein, when the engaging portion engages with the protruding portion, the separation unit is fixed to the main body.

3. The sheet conveyance apparatus according to claim 2, wherein the separation member has a through-hole that runs through a center axis of rotation of the separation member, and wherein, where the support shaft portion is inserted into the through-hole, the separation unit is fixed to the main body and the separation member is supported by the support shaft portion.

4. The sheet conveyance apparatus according to claim 1, wherein, in a state where the separation member is supported by the support shaft portion, the separation member is lifted by the support shaft portion and is urged against the conveyance member and, due to the lifting and the urging, the separation member is not in contact with a holding portion.

5. The sheet conveyance apparatus according to claim 1, wherein, by moving the holding member from a free end side of the support shaft portion to a fixed end side of the support shaft portion in the support shaft portion axial direction, the separation unit is attached to the sheet conveyance apparatus.

6. The sheet conveyance apparatus according to claim 1, wherein the support shaft portion has a torque limiter at the fixed end and is configured to receive driving force from a driving source and to rotate in a rotation direction that is the same as a rotation direction of the conveyance member.

7. The sheet conveyance apparatus according to claim 6, wherein the separation member is configured to come into contact with the conveyance member and form a separation pinch portion, and wherein, in a case where plural sheets are pinched at the separation pinch portion, the separation unit separates the plural sheets one by one by causing the separation member to rotate in the rotation direction that is the same as the rotation direction of the conveyance member.

8. The sheet conveyance apparatus according to claim 1, wherein the guiding member has a fitted portion, and the holding member has a fitting portion that can fit with the guiding member fitted portion, and wherein, by moving the holding member from the free end side of the support shaft portion to the fixed end side of the support shaft portion in the support shaft portion axial direction with the guiding member fitted portion and the holding member fitted portion fitted with each other, the guiding member is moved with the separation unit.

9. The sheet conveyance apparatus according to claim 8, further comprising a fixing portion configured to fix the separation unit to the main body, wherein, in a case where the separation unit is fixed to the main body by the fixing portion, the guiding member is also fixed to the main body.

10. The sheet conveyance apparatus according to claim 1, further comprising a guide portion that neighbors the separation unit and is configured to guide the sheet fed from the storage unit, wherein the guide portion is a part of the storage unit.

11. The sheet conveyance apparatus according to claim 1, wherein the separation member has an elastic portion on a surface of the separation member.

12. The sheet conveyance apparatus according to claim 1, further comprising an opening and closing member configured to open and close relative to the sheet conveyance apparatus, wherein the separation unit is removed from the sheet conveyance apparatus via a space to be formed in a state where the opening and closing member is opened.

13. An image forming apparatus comprising:

an image forming unit for forming an image on a sheet; and a sheet conveyance apparatus having:

a storage unit configured to store the sheet, a conveyance member configured to convey the sheet, a support shaft portion having one end as a fixed end that is fixed to a main body of the sheet conveyance apparatus and the other end as a free end that is not fixed to the main body, a separation unit configured to pinch the sheet with the conveyance member, to convey the pinched sheet with the conveyance member, and to separate, one by one, a plurality of sheets stored in and fed from the storage unit, wherein the separation unit includes a separation member configured to be supported by the support shaft portion and rotatable with the support shaft portion, and includes a holding member holding the separation member in a state where the separation member is not supported by the support shaft portion, and a guiding member that neighbors the separation unit in an axial direction of the support shaft portion and is configured to guide the sheet fed from the storage unit, wherein, by moving the holding member from the fixed end side of the support shaft portion to the free end side of the support shaft portion in the support shaft portion axial direction, the separation unit is removed from the image forming apparatus with the holding member holding the separation member, and wherein, by moving the holding member from the fixed end side of the support shaft portion to the free end side of the support shaft portion in the support shaft portion axial direction, the guiding member moves in the axial direction together with the separation unit.

14. The image forming apparatus to claim 13, further comprising an opening and closing member configured to open and close relative to the image forming apparatus, wherein the separation unit is removed from the image forming apparatus via a space to be formed in a state where the opening and closing member is opened.

* * * * *